US007370457B2

(12) United States Patent
Roberts

(10) Patent No.: US 7,370,457 B2
(45) Date of Patent: May 13, 2008

(54) DUAL CONFIGURATION CONTINUOUS PRECISION REIN SYSTEM

(76) Inventor: Kahne Dean Roberts, 3307 Flickering Candle Dr., Spring, TX (US) 77388-5867

( * ) Notice: Subject to any disclaimer, the term of this patent is extended or adjusted under 35 U.S.C. 154(b) by 0 days.

(21) Appl. No.: 11/643,470

(22) Filed: Dec. 21, 2006

(65) Prior Publication Data

US 2007/0137147 A1 Jun. 21, 2007

Related U.S. Application Data

(60) Provisional application No. 60/753,193, filed on Dec. 21, 2005.

(51) Int. Cl.
*B68B 1/04* (2006.01)

(52) U.S. Cl. ..... 54/36

(58) Field of Classification Search ..... 54/36, 54/6.1, 6.2, 7; 119/795, 797, 798; D30/153, D30/136

See application file for complete search history.

(56) References Cited

U.S. PATENT DOCUMENTS

| | | | | | |
|---|---|---|---|---|---|
| 13,306 | A | * | 7/1855 | Goddard | 54/36 |
| 59,596 | A | * | 11/1866 | Hartman | 54/36 |
| 63,635 | A | * | 4/1867 | Heaton | 54/6.1 |
| 75,614 | A | * | 3/1868 | Woodmansee | 54/36 |
| 206,912 | A | * | 8/1878 | Woolsey | 54/36 |
| 210,836 | A | * | 12/1878 | Blyth | 54/36 |
| 222,468 | A | * | 12/1879 | Davis | 54/36 |
| 501,789 | A | * | 7/1893 | Hoss | 54/36 |
| 505,658 | A | * | 9/1893 | Hill | 54/6.1 |
| 509,882 | A | * | 12/1893 | Easton | 54/36 |
| 1,009,057 | A | * | 11/1911 | Enbysk | 54/36 |
| 5,146,876 | A | * | 9/1992 | McPhail | 119/798 |
| 5,966,911 | A | * | 10/1999 | Gray et al. | 54/36 |

(Continued)

FOREIGN PATENT DOCUMENTS

WO WO 2005044719 A1 * 5/2005

OTHER PUBLICATIONS

Freedomrider.com website excerpts. Webpage entitled "adaptive Horseback Riding Reins—Freedom Rider Tack Shop". The "Adjustable Handle Reins" and the "Rein-Bows" rein loops described in these webpage excerpts existed prior to this invention. (2-page .pdf image of webpage excerpts).

(Continued)

*Primary Examiner*—Son T. Nguyen
(74) *Attorney, Agent, or Firm*—Bacon & Thomas, PLLC

(57) ABSTRACT

The present invention pertains to animal harnesses and particularly to animal reins. More particularly, the invention provides a dual configuration continuous precision rein system which incorporates an adjustable loop on each rein, thus providing a correct contact between the bit and the rider's hands. The rein can be easily converted to a flat strap configuration. In one preferred embodiment, the continuous rein comprises a continuous rein segment attachable at opposed ends to the bit of an animal, wherein the rein contains one or more adjustable loop straps which can be held by the rider to provide correct contact between the rider and the animal when desiring a collected gait from the animal. Alternatively, the rider also has the option of releasing or flattening the loops and holding the continuous rein segment in an extended position to permit the animal to stretch its head down and forward if desired.

19 Claims, 3 Drawing Sheets

U.S. PATENT DOCUMENTS

| | | | | |
|---|---|---|---|---|
| 6,085,500 | A | 7/2000 | Keppick | |
| 6,223,508 | B1 | 5/2001 | Schneider | |
| 6,349,527 | B1 | 2/2002 | Keppick | |
| 6,971,334 | B1 * | 12/2005 | Livesay et al. | 119/798 |
| D515,249 | S | 2/2006 | Mailer | |
| 7,096,827 | B2 * | 8/2006 | Sporn | 119/797 |

OTHER PUBLICATIONS

Deboiz.com website excerpts. "De Boiz UK—Horse Riding Equipment". The "Correct Contact Reins" described in this webpage existed prior to this invention. (5-page .pdf image of webpage excerpts).

Englishridingsupply.com website excerpts. "English Riding Supply". The "Carol Mailer 4—Star Bridgin Rein" depicted in this webpage excerpts existed prior to this invention. (6-page .pdf image of webpage excerpts).

Englishridingsupply.com website excerpts. "English Riding Supply". The "Carol Mailer 5—Star Bridgin Rein" depicted in this webpage excerpts existed prior to this invention. (6-page .pdf image of webpage excerpts).

Reinbows.com website excerpts. "Rein-Bows The adjustable horse rein loop." The "Rein-Bows" rein loops described in these webpage excerpts existed prior to this invention. (6-page .pdf image of webpage excerpts).

Toptackinc.com website excerpts. "Specialized Training Aids—Top Tack". The "Ladder Reins" and "Mike's Bike Handle Reins" described in this webpage excerpts existed prior to this invention. (6-page .pdf image of webpage excerpts).

* cited by examiner

DUAL CONFIGURATION CONTINUOUS PRECISION REIN SYSTEM

CROSS-REFERENCE TO RELATED APPLICATIONS

This application claims the benefit of the filing date of now abandoned U.S. Provisional Patent Application Ser. No. 60/753,193 filed Dec. 21, 2005, Confirmation No. 9183.

STATEMENT REGARDING FEDERALLY SPONSORED RESEARCH OR DEVELOPMENT

Not Applicable.

BACKGROUND OF THE INVENTION

The present invention is related to new and useful improvements in animal harnesses and particularly to animal reins. The invention provides a dual configuration continuous precision rein system which incorporates an adjustable loop on the outside of each rein, thus providing a correct contact between the bit and the rider's hands. Because the adjustable loop can be affixed to the outside of the continuous rein, the rein can be easily converted to a flat strap, the configuration most commonly seen and utilized.

The principal object of the present invention is to provide a novel and improved device by means of which a domestic riding animal such as a horse, donkey or a mule can be controlled when the animal is being ridden. In particular, the invention relates to a continuous rein to which a length of strap is sewn or otherwise affixed, which can be used to form an adjustable loop. This loop is held by a rider which secures a fixed contact between the bit in the animal's mouth and the rider's hands. Because the loops are adjustable, the former problems of maintaining correct contact between riders and animals are eliminated.

Another advantage of the present invention is to provide adjustable harness keepers in which to secure the length of strap when the adjustable loop strap is not in use. The rein is transformed to a traditional flat rein when the loops are laid flat in the adjustable keepers.

BRIEF SUMMARY OF THE INVENTION

This invention provides a rein having a construction which includes an adjustable loop strap which is affixed to the outside of the continuous rein. The rein can be easily converted to a flat rein, the configuration most commonly seen and utilized.

The Precision Rein may be constructed from leather, rubber, nylon, cotton webbing, or any suitably flexible and strong material or combination thereof. The length, width and placement of the adjustable loop strap and buckle will vary to suit the size of the animal and the length of neck.

A purpose of the present invention is to provide a novel and efficient device whereby domestic animals can be ridden with a consistent and correct amount of contact between the rider's hands and the bit in the animal's mouth.

One advantage of the invention is the adjustable loop. When riding different animals, the loop(s) can be lengthened or shortened to provide the correct amount of contact between the rider and the animal Additionally, another advantage to the present invention lies in the ability of the rider to use the adjustable loops on the continuous rein to provide correct contact between the rider and the animal when desiring a collected gait from the animal. Alternatively, the rider also has the option of holding the continuous rein in an extended position to permit the animal to stretch its head down and forward if desired.

Another advantage is to improve a rider's grip when holding onto a loop in the rein. When ordinary reins are used in connection with controlling an animal, the animal will toss its head and body, thus pulling the reins through rider's hands and causing a loss of direct contact between the rider's hands and the bit in the animal's mouth.

Another advantage of the invention is the ability to utilize one loop at a time, maintaining a flat rein on the other side of the animal's neck. This advantage will particularly assist in riding unruly animals in a circular area, such as a race track or when driving a horse from a wheeled carriage, cart or other mechanical device.

A further advantage of this invention is an adjustable harness keeper for use in securing the Adjustable Loop Strap(s), thereby providing an alternate method of controlling an animal, and transforming the rein into a flat rein or traditional tack arrangement.

In one preferred embodiment, the rein comprises a buckle which creates an adjustable loop in a strap permanently sewn or otherwise affixed to a length of rein. One permanent harness keeper is secured between the bit end of the rein and the buckle. An adjustable harness keeper is secured around the rein between the bit end and the permanent harness keeper. Immediately after the buckle, a loop strap with a number of centered and uniformly stamped buckle holes is sewn or otherwise affixed to the outside of the rein, facing away from the riding animal's neck. One adjustable harness keeper is secured between the buckle and the top of the continuous rein, in the direction of rider's hands.

In a preferred embodiment of the present invention there is disclosed and described a continuous rein for establishing a contact between an animal and a rider of the animal comprising: a continuous rein having opposed ends capable of being fastened to a bit worn by the animal, the rein having a bottom side substantially facing toward the body of the animal and a top side facing substantially away from the animal; and one or more adjustable straps attached to the continuous rein. The strap or straps is/are capable of being configured into a first configuration comprising an adjustable loop creating a hand hold for the rider to maintain contact between the animal's bit and the rider's hand(s) and a second configuration comprising having the strap or straps lay substantially flat against the rein. The continuous rein can further comprise one or more keepers positioned on the rein for holding one or more of the straps proximate the rein. The positioning of the keepers can be adjustable. In a preferred embodiment, the material used for the rein comprises leather, rubber, nylon, cotton webbing, or any suitably flexible and strong material or combination thereof. The adjustable strap(s) can comprise leather, rubber, nylon, cotton webbing, or any suitably flexible and strong material or combination thereof. In a preferred embodiment, the the same material is used for the rein and the adjustable strap(s). In a preferred embodiment, the material selected for the rein and the strap(s) is leather In another embodiment, the adjustable strap(s) is/are removably attached to the rein. In yet another preferred embodiment, only one adjustable strap is attached to the rein, while in another embodiment, two adjustable straps are attached to the rein. When two straps are attached to the rein, the can both be used in the same configuration, or different configurations wherein one of the adjustable straps is in the first configuration and the other adjustable strap is in the second configuration. In a preferred embodiment, the continuous rein further comprises a buckle for adjustably securing the strap(s) into its/their first configuration, the strap(s) further comprising a plurality of adjustment holes for use in securing the strap(s) with the buckle. Preferably, the strap(s) is/are attached to the top side of the rein.

In yet another preferred embodiment of the present invention there is disclosed a dual configuration continuous rein comprising: a length of rein having a right bit end and a left bit end opposite the right bit end; a connector on the rein right end for connecting the rein right end to a right side of a bit; a connector on the rein left end for connecting the rein left end to a left side of the bit; a right strap having a first end and a second end opposite the first end, the right strap first end being attached to the rein in a right zone of attachment located closer to the tight rein end than to the left rein end, the tight strap being aligned substantially parallel with the rein such that the right strap can occupy a first configuration substantially laying flat against the rein so that the right strap second end is oriented in the direction toward the rein right end; a right loop connector attached to the rein proximate the right zone of attachment, the right loop connector capable of receiving the right strap second end and securing it into a second configuration to create a loop out of the right strap; a left strap having a first end and a second end opposite the first end, the left strap first end being attached to the rein in a left zone of attachment located closer to the left rein end than to the right rein end, the left strap being aligned substantially parallel with the rein such that the left strap can occupy a first configuration substantially laying flat against the rein so that the left strap second end is oriented in the direction toward the rein left end; a left loop connector attached to the rein proximate the left zone of attachment, the left loop connector capable of receiving the left strap second end and securing it into a second configuration to create a loop out of the left strap; and one or more keepers positioned on the rein for holding said right and lefts straps proximate the rein.

Yet another preferred embodiment disclosed herein pertains to a convertible continuous rein system comprising a continuous rein having opposed ends attachable to a bit worn by an animal, the rein having a bottom side substantially facing toward the body of the animal and a top side facing substantially away from the animal, a rein length and a rein width; an adjustable strap having a first end and a second end opposite the first end, an upper side, a lower side, a width and a length, said strap first end being attached to the rein; a buckle having a tongue or prong, said buckle being located proximate the strap first end; one or more perforations located along a medial portion of the length of the strap capable of receiving the buckle tongue or prong; a first convertible position wherein the strap lays substantially flat in substantially parallel fashion with the rein; and a second convertible position where the strap second end is secured through the buckle to create a hand-hold loop. The convertible continuous rein system can further comprise one or mote keepers positioned on the rein for securing the strap to the rein. In one preferred embodiment, the convertible continuous rein system has the strap first end located closer to one of the opposed ends than the other. The convertible continuous rein system can also further comprise an additional adjustable strap attached to the rein at the opposite end of the rein as the other strap.

Further aspects of the invention will become apparent from consideration of the drawings and the description of preferred embodiments of the invention. A person skilled in the art will realize that other embodiments of the invention are possible and that the details of the invention can be modified in a number of respects, all without departing from the inventive concept. Thus, the drawings and description included herein are to be regarded as illustrative in nature and not restrictive.

Other objects and advantages will be apparent from the following description when taken in connection with the accompanying drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

Figure 1:
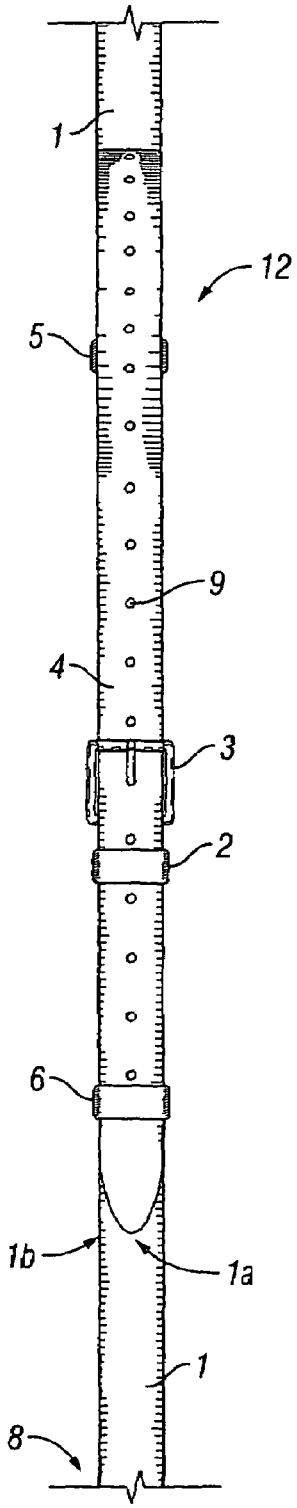
FIG. 1 is a plan view of a preferred embodiment of the present rein invention depicting the loop configuration of the dual configuration rein system.
Figure 2:
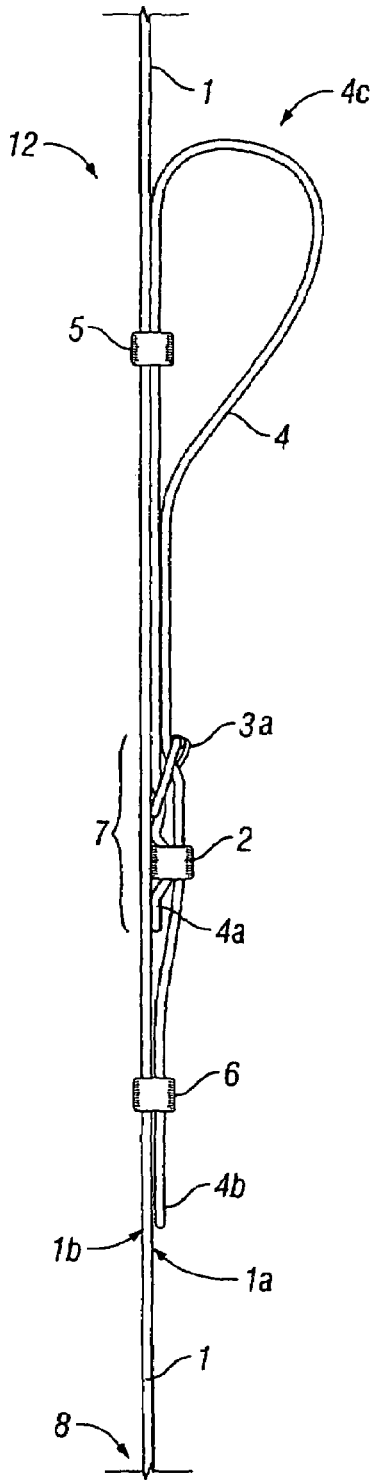
FIG. 2 is a side elevation view of a preferred embodiment of the present rein invention depicting the loop configuration of the dual configuration rein system.
Figure 3:
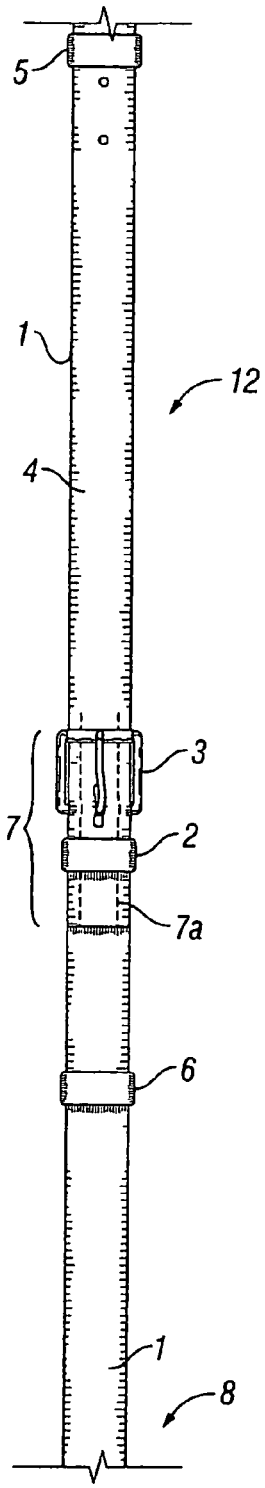
FIG. 3 is a plan view of a preferred embodiment of the present rein invention depicting the flat configuration of the dual configuration rein system.
Figure 4:
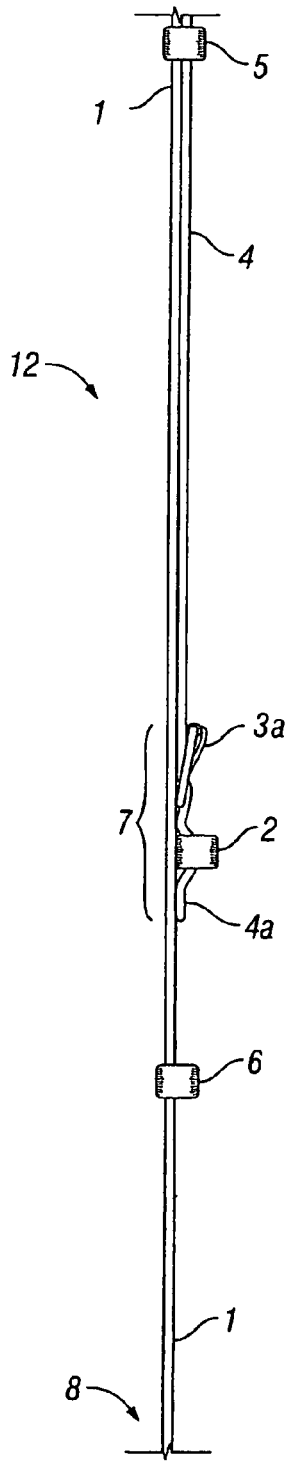
FIG. 4 is a side elevation view of a preferred embodiment of the present rein invention depicting the flat configuration of the dual configuration rein system.
Figure 5:
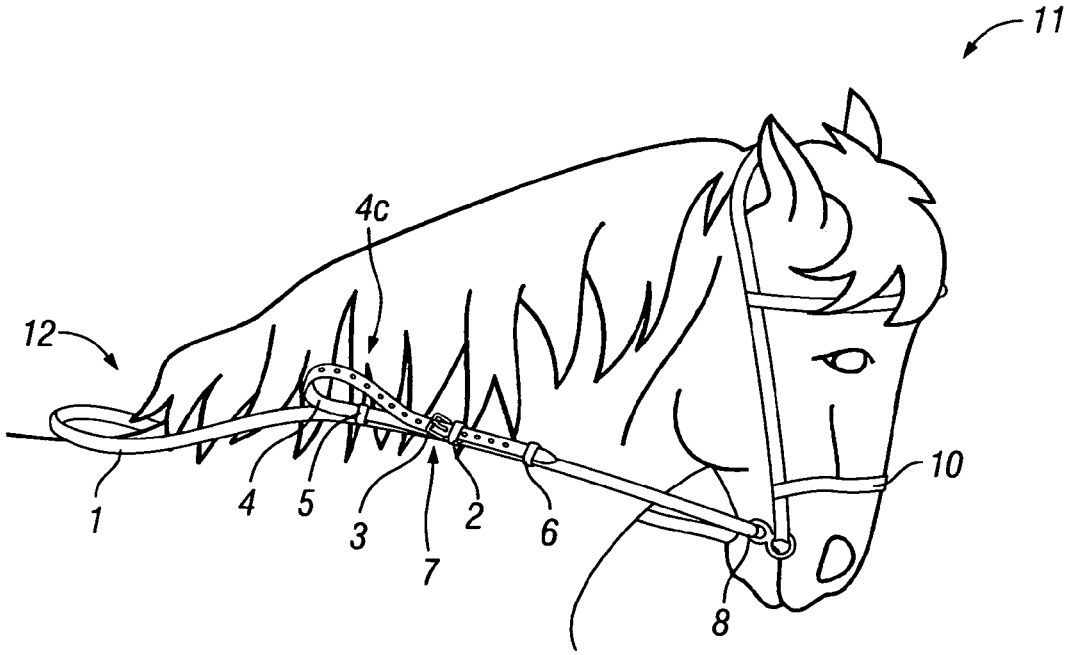
FIG. 5 is an exemplary view of a preferred embodiment of the present rein invention depicting the loop configuration of the dual configuration rein system being used on an animal.
Figure 6:
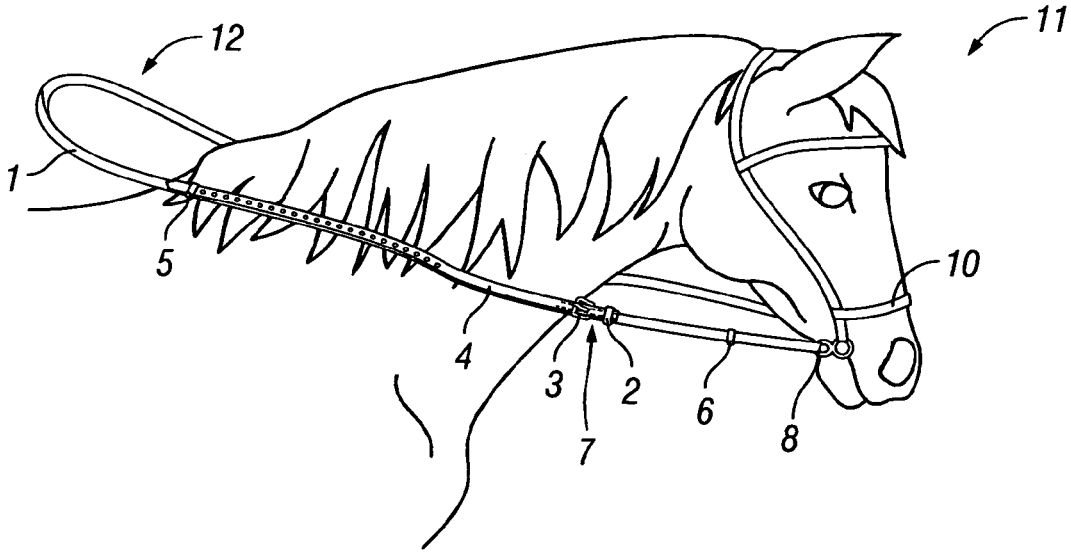
FIG. 6 is an exemplary view of a preferred embodiment of the present rein invention depicting the flat configuration of the dual configuration rein system being used on an animal.

Referring to FIGS. 1, 2 and 5 there is shown a preferred embodiment of a dual configuration continuous precision rein system 12 (shown not to scale) for use with animals 11, such as horses. In a preferred embodiment, the rein system comprises a continuous rein 1 having a top side 1*a* facing away from the animal 11 and a bottom side 1*b* facing the animal. The rein further comprises attached adjustable loop straps 4 that can be configured into a loop 4*c* (e.g. as illustrated in FIGS. 1, 2 and 5) or permitted to stay flat against the rein (e.g., as illustrated in FIGS. 3, 4 and 6). In a preferred embodiment, two loop straps are employed, one for the left side of the rein and one for the right side of the rein so that the rider has the option of holding one loop in each hand.

In another preferred embodiment, the rein 1 is outfitted with only one loop strap mounted on the rein so that the rider can attach the rein such that the loop is either on the left side or the right side of the animal's head.

As will be appreciated, the continuous rein 1 has two opposed ends 8 which can each be attached (using techniques known in the art) to the opposed ends of a bit used in the harness 10 for controlling the animal 11 (bit lap not shown). The opposed bit ends 8 of the continuous rein 1 have attached to them any of the known mechanisms, such as J-hooks, buckles, etc., for attaching the bit ends 8 of the rein to the bit (not shown). Each loop strap 4 preferably comprises an additional length of the same material used for the rein 1, but could be constructed out of other materials. Each loop strap 4 has a first end 4*a* and a second end 4*b* opposite the first end. The first end 4*a* of each loop strap 4 is attached to the continuous rein 1 in the zone of loop attachment 7 using conventional attachment techniques, such as, sewn stiches 7*a*, glue, rivets, compression fittings and the like (or combinations thereof). In a preferred embodiment, sewn stitches are used to attach each strap to the rein. The zone of loop attachment 7 is located preferably at a distance away from each bit end 8 of the rein so that when the loop strap 4 is formed into a loop 4*c*, the loop 4*c* will be in a desired location to enable the rider (not shown) to hold the loop 4*c* while maintaining a desired position on the animal 11. The length of the loop strap 4 is preferably of a length that permits an adequately-sized and positioned loop 4*c* to be formed without leaving the end of the loop strap 4*b* at a position that would over lap the bit end 8 of the rein 1.

To construct a loop 4*c*, the loop strap second end 4*b* is doubled back toward the first end 4*a* and secured to the rein 1 using conventional techniques such as a buckle 3. The buckle 3 (or other loop securing mechanism) is located on the rein 1 in the zone of loop attachment 7. The buckle can preferably be of the variety used on a belt, such as a single tongue 3*a* buckle 3 as depicted in FIGS. 1-4 but other mechanisms can be employed for securing the loop strap 4 (near its second end 4*b*) to the rein 1 and permitting the adjustability of the loop size. The buckle can also be used in combination with a buckle keeper 2. Where a traditional buckle device 3 is employed, each loop strap 4 also contains a plurality of adjustment holes or perforations 9 near the loop strap second end 4*b* (much like those on a leather belt) located substantially in the medial portion of the width of the strap in spaced relation to permit adjustability of the loop size. The rein also preferably comprises a buckle keeper 2 proximate the buckle 3 capable of receiving the second end 4*b* of the loop strap after it passes through the buckle 3 or other securing device. In a preferred embodiment, the buckle keeper 2 is fixably attached to the rein, but it could also be slidably attached so that it surrounds the rein 1 and the loop strap 4 and provides adjustability to its position along the rein. An end-of-loop keeper 6 can also be employed on the rein 1 to receive the second end 4*b* of the loop 4 and keep the loop end 4*b* snug against the rein 1. The end-of-loop keeper 6 is preferably slidably located on the rein between the buckle 3 and the bit end 8 to accommodate differing lengths of loop strap 4 that exit the buckle 3. If desired, a plurality of end-of-loop keepers 6 can be employed.

Additionally, to assist in the creation and adjustment of the loops 4*c*, the continuous rein 1 preferably also employs a loop adjustment keeper 5 which is preferably slidably mounted on the rein 1 at a position between the rider and the buckle 3. This loop adjustment keeper is sized to receive the both the rein 1 and the loop strap 4 and maintain a the portion of the loop strap 4 proximate the loop keeper 5 in snug contact with the rein 1. As may be desired, additional loop adjustment keepers can be employed along the length of the rein between the buckle and the rider to secure the loop strap 4 along varying lengths of the rein 1.

As will be appreciated from a review of the present invention, when the rein 1 is used in the loop configuration shown in FIGS. 1, 2 and 5, the adjustability of the loop strap length provides flexibility in locating the position of the loop 4*c* along the reins to account for, e.g., the stature of the rider, the rider's arm length, the rider's positioning on the animal, the size of the animal and the neck size of the animal. When the animal 11 is involved in a show, such as a horse show, the preferred rein material is leather. With a leather rein, the preferred loop locking mechanism is a buckle (much like a belt buckle).

When the precision rein is configured in the looped configuration, the adjustable loop strap 4 is reversed in a looped position 4*c* just after the adjustable loop keeper 5, and secured through the buckle 3 and the buckle keeper 2 (which preferably is fixably attached) and also into adjustable harness keeper 6. In this preferred embodiment of the dual configured precision rein system of the present invention, the rider will lengthen or shorten the adjustable loop strap 4, securing the loop through the buckle 3 to accurately provide correct contact loops for the rider's hands.

In use, a preferred embodiment of the invention is operated by reversing the adjustable loop strap 4, just after the adjustable loop keeper 5, into the buckle 3 then fastening the buckle through a hole 9 which would produce the most effective length of contact for the rider, and securing the strap 4 through the buckle keeper 2 (preferably fixably attached proximate the buckle 3) and also into an adjustable harness keeper 6 located near the bit end of the rein end between the buckle 3 and the bit lap (not shown).

Referring now to FIGS. 3, 4 and 6, in another alternate preferred embodiment of the dual configuration precision rein system invention, the adjustable loop strap 4 is not inserted into the buckle 3, but rather is inserted through the adjustable loop strap keeper(s) 5, thereby transforming the adjustable loop strap 4 into a conventional continuous rein.

The continuous rein 1 may be constructed from leather, rubber, nylon, cotton webbing, or any suitably flexible and strong material or combination thereof. The length, and width of the rein 1 will vary to suit the size of the animal and the length of neck. When leather is used, it is preferred to use strong, high quality supple leather, tightly stitched. The leather could also have hand blocked edges.

The keepers 2, 5, 6 may be made of leather, rubber, nylon, cotton webbing, or any suitably flexible and strong material or combination thereof.

The buckle 3 may be any type of harness buckle which is suitably sized to the width of the continuous rein 1. In one embodiment, a "Conway" buckle is used The placement of the buckle 3 along the rein in the zone of attachment 7 will vary to suit the size of the animal and the length of neck. In a preferred embodiment, the harness buckle is made of a strong and rustproof material such as stainless steel.

The adjustable loop strap 4 may be constructed from leather, rubber, nylon, cotton webbing, or any suitably flexible and strong material or combination thereof. The length, width and placement of the adjustable loop strap will vary to suit the size of the animal and the length of neck.

In a preferred embodiment of the invention, the precision rein 1 comprises one continuous rein (from bit end to bit end) with the adjustable loop strap(s) permanently affixed to the top side surface 1*a* of the rein 1 facing away from the horses' neck.

Although the present invention and its advantages have been described in detail, it should be understood that various changes, substitutions, and alterations could be made herein without departing from the spirit and scope of the invention as described herein. While the apparatus of this invention have been described in terms of preferred embodiments, it will be apparent to those of skill in the art that variations may be applied to the embodiments described herein without departing from the concept and scope of the invention. All such similar substitutes and modifications apparent to those skilled in the art are deemed to be within the scope and concept of the invention.

I claim:

1. A dual configuration continuous rein comprising:

(a) a length of rein having a right bit end and a left bit end opposite the right bit end;

(b) a connector on the rein right end for connecting the rein right end to a right side of a bit;

(c) a connector on the rein left end for connecting the rein left end to a left side of the bit;

(d) a right strap having a first end and a second end opposite the first end, the right strap first end being attached to the rein in a right zone of attachment located closer to the right rein end than to the left rein end, the right strap being aligned substantially parallel with the rein such that the right strap can occupy a first configuration substantially laying flat against the rein so that the right strap second end is oriented in the direction toward the rein right end;

(e) a right loop connector attached to the rein proximate the right zone of attachment, the right loop connector capable of receiving the right strap second end and securing it into a second configuration to create a loop out of the right strap;

(f) a left strap having a first end and a second end opposite the first end, the left strap first end being attached to the rein in a left zone of attachment located closer to the left rein end than to the right rein end, the left strap being aligned substantially parallel with the rein such that the left strap can occupy a first configuration substantially laying flat against the rein so that the left strap second end is oriented in the direction toward the rein left end;

(g) a left loop connector attached to the rein proximate the left zone of attachment, the left loop connector capable of receiving the left strap second end and securing it into a second configuration to create a loop out of the left strap; and (h) one or more keepers positioned on the rein for holding said right and lefts straps proximate the rein.

2. The dual configuration continuous rein of claim 1 wherein the positioning of the one or more keepers is adjustable.

3. The dual configuration continuous rein of claim 1 wherein the material used for the rein comprises leather, rubber, nylon, cotton webbing, or any suitably flexible and strong material or combination thereof.

4. The dual configuration continuous rein of claim 1 wherein the material used for the left and right straps comprises leather, rubber, nylon, cotton webbing, or any suitably flexible and strong material or combination thereof.

5. The dual configuration continuous rein of claim 1 wherein the same material is used for the rein and the left and right straps.

6. The dual configuration continuous rein of claim 1 wherein the material used for the rein and the left and right straps comprises leather.

7. The dual configuration continuous rein of claim 1 wherein the left and right straps are removably attached to the rein.

8. The dual configuration continuous rein of claim 1 further comprising buckles for adjustably securing said left and right straps into their first configuration, said left and right straps further comprising a plurality of adjustment holes for use in securing said left and right straps with the buckles.

9. A convertible continuous rein system comprising:

(a) a continuous rein having opposed ends attachable to a bit worn by an animal, the rein having a bottom side substantially facing toward the body of the animal and a top side facing substantially away from the animal, a rein length and a rein width;

(b) an adjustable strap having a first end and a second end opposite the first end, an upper side, a lower side, a width and a length, said strap first end being attached to the rein;

(c) a buckle having a tongue or prong, said buckle being located proximate the strap first end;

(d) one or more perforations located along a medial portion of the length of the strap capable of receiving the buckle tongue or prong;

(e) a first convertible position wherein the strap lays substantially flat in substantially parallel fashion with the rein; and (f) a second convertible position where the strap second end is secured through the buckle to create a hand-hold loop.

10. The convertible continuous rein system of claim 9 further comprising one or more keepers positioned on the rein for securing the strap to the rein.

11. The convertible continuous rein system of claim 10 wherein the positioning of the one or more keepers is adjustable.

12. The convertible continuous rein system of claim 9 wherein said strap first end is located closer to one of the opposed ends than the other.

13. The convertible continuous rein system of claim 9 further comprising an additional adjustable strap attached to the rein at the opposite end of the rein as the other strap.

14. The convertible continuous rein of claim 9 wherein the material used for the rein comprises leather, rubber, nylon, cotton webbing, or any suitably flexible and strong material or combination thereof.

15. The convertible continuous rein of claim 9 wherein the material used for the adjustable strap comprises leather, rubber, nylon, cotton webbing, or any suitably flexible and strong material or combination thereof.

16. The convertible continuous rein of claim 9 wherein the same material is used for the rein and the adjustable strap.

17. The convertible continuous rein of claim 9 wherein the material used for the rein and the adjustable strap comprises leather.

18. The convertible continuous rein of claim 9 wherein the adjustable strap is removably attached to the rein.

19. The convertible continuous rein of claim 9 wherein the adjustable strap is attached to the top side of the rein.

* * * * *